United States Patent [19]

Hinkle

[11] 4,007,849

[45] Feb. 15, 1977

[54] SAFETY CONTAINER

[76] Inventor: Donald B. Hinkle, 12151 Brougham, Sterling Heights, Mich. 48077

[22] Filed: Mar. 29, 1976

[21] Appl. No.: 671,481

[52] U.S. Cl. ..... 215/213; 220/251; 220/323; 206/1.5

[51] Int. Cl.[2] ..... B65D 55/02; B65D 85/56; A61J 1/00

[58] Field of Search ..... 215/211, 213, 294, 296, 215/301; 206/1.5; 220/250, 251, 323

[56] References Cited

UNITED STATES PATENTS

| | | | |
|---|---|---|---|
| 1,160,010 | 11/1915 | Svenson | 220/251 X |
| 1,728,945 | 9/1929 | Porter | 220/323 X |
| 2,772,809 | 12/1956 | Ross | 220/323 X |

*Primary Examiner*—George T. Hall
*Attorney, Agent, or Firm*—William L. Fisher

[57] ABSTRACT

Improvement in a safety container for medicine having a cap and bottle, the cap constructed in relation to the bottle such that in one position thereof the cap can be lifted off the bottle and in another position thereof the cap cannot be removed from the bottle, the improvement comprising a detent associated with the cap, the detent moveable in respect to the cap and having a lock and unlock position in respect thereto, a cooperative arrangement on the bottle capable of engaging with the detent to lock the cap on the bottle, and a manually actuable handle on the cap capable of moving the detent between lock and unlock positions thereof the detent being flexible, the handle operative during actuation thereof to flex the detent to move it between its lock and unlock positions.

10 Claims, 7 Drawing Figures

SAFETY CONTAINER

My invention relates to safety containers for medicine.

Many authorized users of safety containers for medicine find it difficult to open them. Some caps have to be rotated while being pushed upon and others have to be rotated to certain positions and lifted off with a small tab. Users suffering from disabilities such as poor eyesight or arthritis of the hands cannot use these containers.

The principal object of my invention is the provision of improvements in safety containers for medicine which make them easier to open for authorized users thereof while still maintaining them safe against opening by children.

The foregoing object of my invention and the advantages thereof will become apparent during the course of the following description, taken in conjunction with the accompanying drawings, in which:

FIG. 1 is a top plan view of a safety container embodying my invention;

FIGS. 3 and 4 are vertical sectional views of the structure of FIG. 1 taken on the lines 3—3 and 4—4 thereof;

Figure 1:
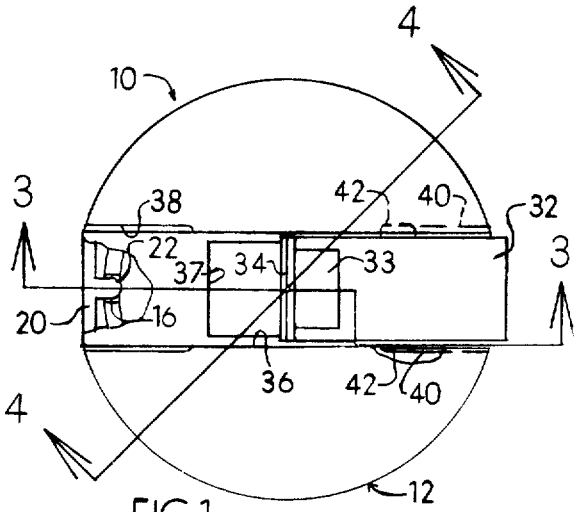
Figure 5:
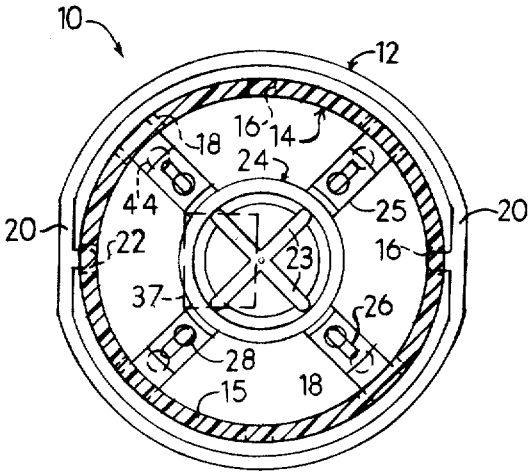
FIG. 5 is a horizontal sectional view of the structure of FIG. 4 taken on the line 5—5 thereof.

Referring to the drawings in greater detail, 10 generally designates said container which includes a cap 12 and bottle 14. The cap 12 has both a lock and unlock position on the bottle 14 as will be described. The bottle 14 has a bottom wall (not shown) and a cylindrical side wall 14 in which are formed four equally spaced apart open-end slots 16 and apertures 18. The cap 12 has a top wall 11 and a cylindrical side wall 13 except for opposite flats 20 formed therein. Said flats 20 have inwardly projecting bosses 22 which fit in any opposite pairs of the slots 16. The cap 12 carries on the underside thereof a flexible disk 24 having a circular center section provided with strengthening ribs 23 and four arms 25 having slots 26 therein. Hangers 28 which have enlarged heads project from the underside of the cap 12 and are pushed so that the heads thereof pass through the slots 26 to hold the disk 24 affixed to the cap 12. Between said center section and the slots 26 the arms 25 are provided with hinges 30 for purposes which will appear. The cap 12 is provided with a handle 32 having a hinge 34 by which said handle 32 can be swung from one side to the other of the cap 12 for controlling the lock and unlock position of the latter. The cap is also provided with a channel 36 which receives the handle 32 in its extreme positions. Said channel 36 is widened, as at 38, at one end and has lengthwise extending slots 40 therein at the other. A rectangular aperture 37 is formed in said cap through the floor of said channel 36.

Figure 3:
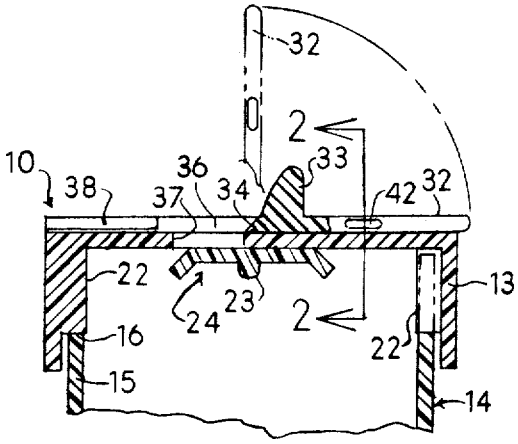
Figure 6:
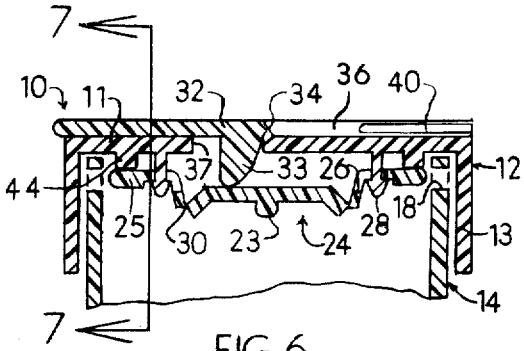
FIG. 6 is a view similar to FIG. 4 showing the container cap in an unlock position thereof.
Figure 4:
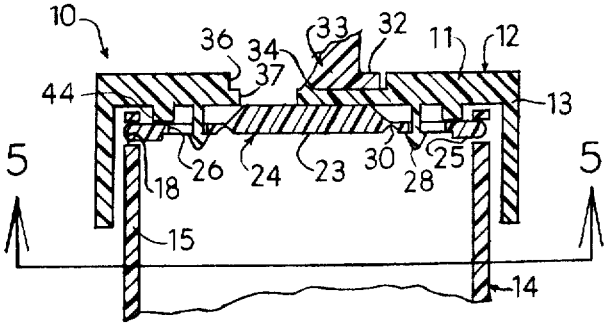
Figure 2:
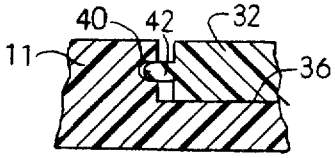
FIG. 2 is a vertical sectional view of the structure of FIG. 3 taken on the line 2—2 thereof.
Figure 7:
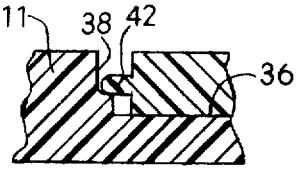
FIG. 7 is a vertical sectional view of the structure of FIG. 6 taken on the line 7—7 thereof.

Detents 42 are formed on the edges of the handle 32 and a protuberance 33 is formed on one side thereof. The nature of the hinge 34 is such that the handle 32 tends to assume its molded position which is shown in phantom lines in FIG. 3 in which said handle 32 upstands from the cap 12. The handle 32 has to be snapped into its lock position shown in solid lines in FIGS. 1, 3 and 4 in which the detents 42 enter the slots 40 and retain the handle 32 in its lock position on the cap 12. In this position of the handle 32 the protuberance 33 upstands from the cap 12 and the arms 25 extend into the apertures 18 to lock the cap 12 on the bottle 14. The free end of the handle 32 extends beyond the wall 13 of the cap 12 so that it can be lifted up to move the handle 32 out of its lock position. When the handle 32 is thus lifted out of its lock position and swung to an opposite extreme position thereof, as shown in FIGS. 2 and 6, the protuberance 33 enters and passes through the aperture 37 and pushes upon said center section of the disk 24. This action causes said center section to move downwardly and the arms 25 to flex on the hinges 30 so that the free ends of said arms 25 retract out of the apertures 18 to unlock the cap 12 from the bottle 14. By holding the handle 32 in its unlock position the user may lift the cap 12 off the bottle 14 to obtain what medicine he needs therein. When the handle 32 is released the disk 24 returns to its lock position shown in FIG. 4 since this is the molded position of the hinges 30. As shown in FIG. 7, the widened portion 38 of the channel 36 is formed so that the handle 32 will not be retained in its unlock position but will return to its molded upright position which is desirable from a safety standpoint. Guide posts 44 are formed on the underside of the cap 12 to guide the movement of the free ends of the arms 25 in and out of the apertures 18.

In use of said container 10, in order to remove the cap 12 from the bottle 14, the handle 32 must be lifted upon to snap the detents 42 out of the slots 40 and then swung to its unlock position. In this position the protuberance 33 passes downwardly upon the center section of the disk 24 to flex the arms 25 on their hinges 30 so as to retract the arms 25 out of the apertures 18. The cap 12 can then be lifted off the bottle 14 and after the user obtains what medicine he needs therefrom, the cap 12 may be replaced on the bottle 14 by holding the handle 32 in its unlock position so that the arms 25 remain fully retracted. In this position the bosses 27 may be inserted in one or the other of the two sets of slots 16. When this is accomplished the handle 32 may be released and it will tend to swing back toward its molded upright position. The handle 32 can then be swung to its lock position and pushed downwardly upon to snap the detents 42 into the slots 40. In this position the handle 32 will be locked in place and the disk 24 will flex back into its lock position because of the "memory" of the hinges 30 and cause the free ends of the arms 25 to move into the apertures 18 to lock the cap 12 to the bottle 14.

It will thus be seen that there has been provided by my invention a safety container for medicine in which the object hereinabove set forth, together with many thoroughly practical advantages, has been successfully achieved. For example, the handle 32 is ample and easy for a user to hold and manipulate which is all that is required to lock and unlock the cap 12 in respect to the bottle 14. The cap 12 cannot be removed from the bottle 14 by infants or tender age children and thus qualifies as a safety container for medicine. While a preferred embodiment of my invention has been shown and described, it is to be understood that variations and changes may be resorted to without departing from the spirit of my invention as defined by the appended claims.

What I claim is:

1. Improvement in a safety container for medicine having a cap and bottle, said cap constructed in relation to the bottle such that in one position thereof the cap can be lifted off the bottle and in another position thereof the cap cannot be removed from the bottle, said improvement comprising detent means associated with the cap, said detent means moveable in respect to said cap and having a lock and unlock position in respect thereto, cooperative means on the bottle capable of engaging with said detent means to lock said cap on the bottle, and manually actuable handle means on the cap capable of moving said detent means between lock and unlock positions thereof, said detent means being flexible, said handle means operative during actuation thereof upon said detent means to flex the same to move it between its lock and unlock positions.

2. Improvement in a safety container for medicine having a cap and bottle, said cap constructed in relation to the bottle such that in one position thereof the cap can be lifted off the bottle and in another position thereof the cap cannot be removed from the bottle, said improvement comprising detent means associated with the cap, said detent means moveable in respect to said cap and having a lock and unlock position in respect thereto, cooperative means on the bottle capable of engaging with said detent means to lock said cap on the bottle, and manually actuable handle means on the cap capable of moving said detent means between lock and unlock positions thereof, said detent means comprising a flexible disk having arms, said handle means being hinged on the cap and having lock and unlock positions in respect thereto, said cooperative means on the bottle comprising apertures therein, said arms disposed in said apertures to lock the cap on the bottle, said handle means operative to flex said disk to move said arms out of said apertures to unlock said cap.

3. Improvement as claimed in claim 1, said handle means operative to push upon said detent means to flex the same to move it between its lock and unlock positions.

4. Improvement as claimed in claim 3, means on said cap to prevent said handle means from being retained in its unlock position on the cap so that said handle means moves out of its unlock position upon release thereof.

5. Improvement as claimed in claim 2, means for attaching said disk to the underside of said cap, said handle means having a protuberance thereon which presses upon said disk to cause flexure thereof.

6. Improvement as claimed in claim 5, said arms having slots therein, said attaching means extending through said slots, said arms moveable in respect to said attaching means via said slots, and guide means on the underside of said cap for guiding the movement of the ends of said arms in and out of said apertures.

7. Improvement as claimed in claim 2, said disk having a center section, said handle means arranged to press upon said center section, hinge means joining said arms and said disk, the flexure of said disk occurring at said hinge means when said handle means presses upon said center section.

8. Improvement in a safety container for medicine, said improvement comprising the method of locking and unlocking the cap in respect to the bottle which utilizes detent means associated with the cap, said detent means moveable between lock and unlock positions in respect to said cap, said method including manually actuating a handle on the cap to move said detent means between lock and unlock positions thereof, said detent means being flexible, and flexing said detent means to move it between its lock and unlock positions, said flexing of said detent means being accomplished by said handle during actuation thereof.

9. Improvement in a safety container for medicine, said improvement comprising the method of locking and unlocking the cap in respect to the bottle which utilizes detent means associated with the cap, said detent means moveable between lock and unlock positions in respect to said cap, said method including manually actuating a handle on the cap to move said detent means between lock and unlock positions thereof, utilizing apertures in the bottle, and said detent means including a flexible disk having arms which move in and out of said apertures, moving said arms by flexing said disk, and flexing said disk by pushing upon the same with said handle.

10. Improvement as claimed in claim 9, said method further comprising hinging said arms and the center section of said disk, the flexure of said disk occurring at said hinging when said handle means presses upon said center section.

* * * * *